US005782014A

United States Patent [19]

Peterson

[11] Patent Number: 5,782,014

[45] Date of Patent: Jul. 21, 1998

[54] ATHLETIC SHOE HAVING SPRING CUSHIONED MIDSOLE

[75] Inventor: William R. Peterson, Granada Hills, Calif.

[73] Assignee: K-Swiss Inc., Chatsworth, Calif.

[21] Appl. No.: 669,934

[22] Filed: Jun. 25, 1996

[51] Int. Cl.[6] ..... A43B 13/20; A43B 13/26

[52] U.S. Cl. ..... 36/38; 36/29; 36/31; 36/35 B; 36/37

[58] Field of Search ..... 36/27, 28, 29, 36/30 A, 30 R, 31, 35 R, 35 B, 37, 3 B

[56] References Cited

U.S. PATENT DOCUMENTS

| | | | |
|---|---|---|---|
| D. 298,583 | 11/1988 | Yung-Mao . | |
| D. 315,634 | 3/1991 | Yung-Mao . | |
| D. 328,385 | 8/1992 | Hatfield . | |
| D. 336,771 | 6/1993 | Hatfield et al. . | |
| D. 339,674 | 9/1993 | Aver . | |
| D. 340,350 | 10/1993 | Kilgore et al. . | |
| D. 373,013 | 8/1996 | Rosetta . | |
| 456,677 | 7/1891 | McIntyre | 36/37 |
| 588,977 | 8/1897 | Gilbert | 36/3 B |
| 922,094 | 5/1909 | Cummings . | |
| 1,044,015 | 11/1912 | Byrne . | |
| 4,215,492 | 8/1980 | Sandmeier . | |
| 4,223,455 | 9/1980 | Vermeulen . | |
| 4,262,433 | 4/1981 | Hagg et al. . | |
| 4,345,387 | 8/1982 | Daswick . | |
| 4,535,553 | 8/1985 | Derderian et al. . | |
| 4,697,362 | 10/1987 | Wasserman . | |
| 4,712,314 | 12/1987 | Sigoloff . | |
| 4,733,483 | 3/1988 | Lin . | |
| 4,817,304 | 4/1989 | Parker et al. . | |
| 4,843,741 | 7/1989 | Yung-Mao . | |
| 4,845,861 | 7/1989 | Moumdjian . | |
| 4,845,863 | 7/1989 | Yung-Mao . | |
| 4,881,328 | 11/1989 | Yung-Mao . | |
| 4,905,382 | 3/1990 | Lin . | |
| 4,908,962 | 3/1990 | Yung-Mao . | |
| 5,084,988 | 2/1992 | Berger . | |
| 5,092,060 | 3/1992 | Frachey et al. . | |
| 5,152,081 | 10/1992 | Hallenbeck et al. . | |
| 5,174,049 | 12/1992 | Flemming . | |
| 5,201,125 | 4/1993 | Shorten . | |
| 5,222,311 | 6/1993 | Lin . | |
| 5,224,277 | 7/1993 | Sang Do . | |
| 5,233,767 | 8/1993 | Kramer . | |
| 5,311,674 | 5/1994 | Santiyanont et al. . | |
| 5,331,750 | 7/1994 | Sasaki et al. . | |
| 5,369,896 | 12/1994 | Frachey et al. . | |
| 5,384,977 | 1/1995 | Chee . | |
| 5,402,588 | 4/1995 | Graham et al. . | |
| 5,493,791 | 2/1996 | Kramer . | |
| 5,517,770 | 5/1996 | Martin et al. . | |
| 5,572,804 | 11/1996 | Skaja et al. . | |
| 5,619,809 | 4/1997 | Sessa . | |

FOREIGN PATENT DOCUMENTS

| | | | |
|---|---|---|---|
| 806647 | 6/1948 | Germany | 36/29 |

*Primary Examiner*—Paul T. Sewell
*Assistant Examiner*—Anthony Stashick
*Attorney, Agent, or Firm*—Oblon, Spivak, McClelland, Maier & Neustadt, P.C.

[57] ABSTRACT

An athletic shoe having a spring cushioned midsole assembly which is advantageous from a combined stability and impact absorption/energy dissipation standpoint. A preferred form of the invention includes a spring foam midsole unit having plural spaced projections in forefoot and heel regions, with an additional spring foam heel unit having projections facing the projections of the heel portion of the midsole unit. In addition, the central region of the midsole unit is substantially flat to provide sufficient support and stability, while also providing advantageous impact/force absorption and energy dissipation in the front and heel regions of the shoe. By providing spaced projections, in combination with a modulator or base portion having a substantial thickness, the projections can act independently with respect to one another and can interact with the modulator portion to provide an advantageous stable cushioning effect. In an optional aspect of the invention, a mock window is disposed in the exterior of the shoe, and includes a mock representation of the cushioned midsole assembly.

20 Claims, 4 Drawing Sheets

ATHLETIC SHOE HAVING SPRING CUSHIONED MIDSOLE

BACKGROUND OF THE INVENTION

1. Field of the Invention:

The invention relates to an athletic shoe and particularly to an athletic shoe having a spring foam midsole which is advantageous from a standpoint of reducing stresses and dissipating energy associated with various athletic activities while also maintaining satisfactory stability.

2. Discussion of Background:

In order to provide improved cushioning and impact absorbtion, athletic shoes have been provided with air cushions disposed within the sole structure of the shoe. However, air cushioned arrangements can be undesirable in that the stability of the shoe is diminished as a result of the air cushioned support. As an alternative to air cushions, athletic shoes have been provided with cushioning wedges disposed between the insole and the outsole of the shoe. By way of example, U.S. Pat. No. 5,222,311 to Lin discloses a shoe in which a cushioning wedge is disposed within a receptacle of an outsole. In the Lin arrangement, closely packed side-by-side cushioning elements are provided in the form of curved projections extending from a base member. With such a closely packed arrangement, the cushioning elements effectively act as a unit. As a result, if a soft cushioning material is utilized the stability of the shoe is compromised, and the shoe can be hazardous when participating in various athletic activities. By contrast, when a harder cushioning material is utilized, the capacity of the cushioning wedge to relieve stresses or absorb impacts is reduced.

U.S. Pat. No. 4,485,863 also discloses a shoe in which cushioning elements are disposed in side-by-side relation. In addition a window extends through the side of the sole of the shoe so that the cushioning elements can be observed from the exterior of the shoe. As discussed above, with such an arrangement, the cushioning assembly is less than optimal from a combined stability and impact absorption standpoint. In addition, by providing a window which extends through the side of the shoe, the structural integrity of the shoe is diminished, or the shoe must be constructed to accommodate for the loss of strength resulting from the window opening.

SUMMARY OF THE INVENTION

It is an object of the present invention to provide an improved athletic shoe having desirable cushioning/impact absorbing qualities while maintaining a high level of stability.

It is another object of the invention to provide an athletic shoe having a midsole which includes a cushioning unit having a modulator member with a plurality of projections extending therefrom, with the projections spaced with respect to one another so that the interaction between the projections and the modulator provide a spring cushioning arrangement which stably dampens impact forces.

It is yet another object of the invention to provide an athletic shoe having an arrangement of cushioning elements which provide increased cushioning/impact absorption in regions subjected to higher forces or stresses, while areas requiring support have lower cushioning/impact absorption qualities, with the overall construction providing a stable, cushioned midsole assembly.

The foregoing, and additional objects and advantages are achieved in accordance with the present invention which includes a midsole cushioning assembly having a modulator or base of a substantial thickness, with a plurality of spaced projections extending from the modulator. In a preferred embodiment, the midsole of the shoe includes a pocket which receives a spring foam cushioning assembly of the present invention, and the spring foam assembly includes a midsole unit having a modulator portion of a substantial thickness, with a plurality of spaced projections provided in the forefoot and heel regions, while the center region of the midsole unit is substantially flat. An additional heel unit is also provided, and the heel unit also includes a modulator or base member having projections extending therefrom, with the projections of the heel unit facing the corresponding projections of the heel portion of the midsole unit. The arrangement of the present invention is advantageous in that the projections are sufficiently spaced so that they can substantially independently interact with the modulator or base member, to thereby provide a spring cushioning effect. In addition, by providing projections in selected regions of the midsole unit, greater support is provided in certain regions (such as in the arch region of the shoe), while greater cushioning is provided in regions subjected to higher impact forces (such as in the heel region and forefoot regions). In addition, by providing a double cushioning arrangement in the heel region, with projection of the cushions facing each other, this region is particularly efficient in dissipating energy and absorbing undesirable impact forces. Moreover, by utilizing spaced projections which interact with the modulator independently, a stable cushioning effect is obtained. The stability of the cushioned midsole is further enhanced by disposing the cushioning assembly within a pocket of the shoe midsole. The midsole pocket includes three pocket portions having differing depths in the preferred embodiment.

In accordance with a further aspect of the invention, a mock window display is provided on the exterior of the shoe, to display, e.g., a mock of the cushioning elements. This mock display is advantageous in providing information regarding the structure/function of the cushioning elements, while minimizing any compromise in the structural integrity of the shoe.

BRIEF DESCRIPTION OF THE DRAWINGS

A more complete appreciation of the invention and many of the attendant advantages thereof will be readily obtained as the same becomes better understood with reference to the following detailed description, particularly when considered in conjunction with the accompanying drawings, in which.

DESCRIPTION OF THE PREFERRED EMBODIMENTS

Figure 1:
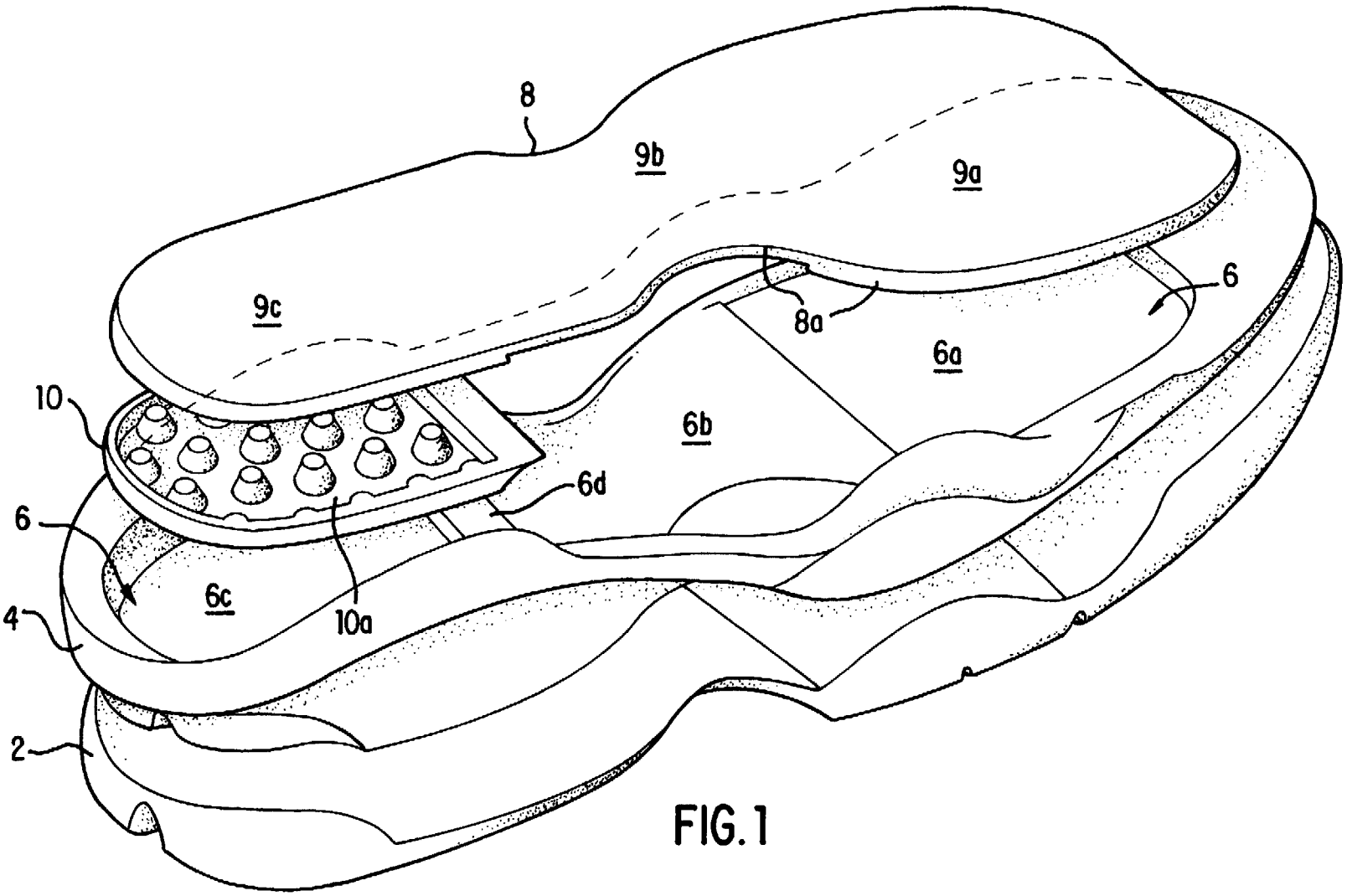
FIG. 1 is a perspective view of the sole, midsole, and midsole cushioning assembly of the present invention.

Referring now to the drawings, wherein like reference numerals designate identical or corresponding parts throughout the several views, FIG. 1 depicts the sole/ midsole assembly of the present invention, and particularly the relationship of the sole, midsole and midsole cushioning assembly of the present invention. As shown in FIG. 1, a midsole 4 is disposed above an outsole 2. Upon assembly of the shoe, the midsole 4 is fastened to the sole 2, e.g., utilizing an adhesive.

The midsole includes a pocket 6 having differing depths in order to receive a spring foam midsole cushioning assembly of the present invention as discussed further hereinafter. In a particularly preferred form of the invention, the pocket of the midsole includes an intermediate depth pocket portion 6*a*, a shallow depth pocket portion 6*b*, and a deep depth pocket portion 6*c*. The spring foam midsole cushioning assembly includes a midsole unit 8 and a heel unit 10. As also shown in FIG. 1, the midsole unit 8 includes a modulator portion 8*a* having a substantial thickness, so that the midsole unit is able to support spaced, independent projections as will be discussed further hereinafter. In a currently preferred form, the modulator or base portion of the midsole unit is formed of a urethane foam material having a Shore C hardness of 60–80, and a thickness of 2–4 mm, with the thickness preferably 2–3 mm. Of course, other materials and proportions are also possible. However, this thickness of the modulator portion has been found advantageous in combination with spaced projections so that the projections substantially independently interact with the modulator to provide a stable spring form cushioned midsole assembly.

Still referring to FIG. 1, the heel unit 10 also includes a base or modulator portion 10*a*, which may be of the same material and/or thickness as that of the modulator portion 8*a* of the midsole unit 8. However, the heel unit and modulator portion 10*a* may also have a different thickness and/or hardness as compared with the midsole unit, if desired.

The forefoot region 9*a* of the midsole unit 8 is received within the intermediate depth pocket 6*a* of the midsole 6, while the center region 9*b* of the midsole unit 8 is received within the shallow depth portion 6*b* of the midsole pocket 6, and the heel unit 10 and the heel portion 9*c* of the midsole unit 8 are received within the deep depth portion 6*c* of the pocket 6.

Figure 2A:
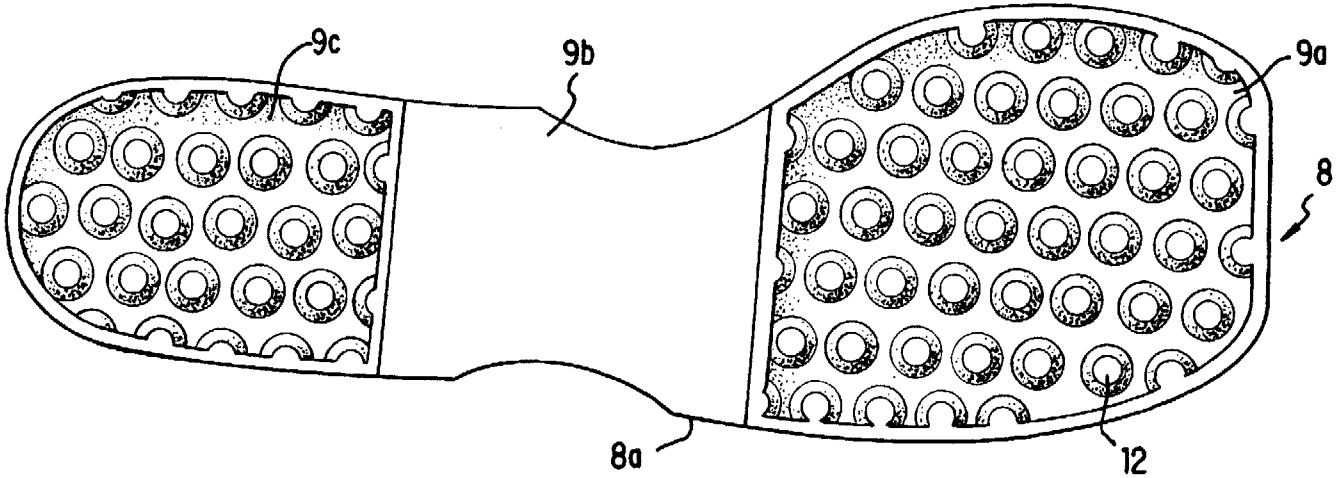
FIGS. 2A and 2B respectively depict the midsole unit and heel unit which form the preferred cushioning assembly of the present invention.

As shown in FIG. 2A, the midsole unit 8 includes projections 12 disposed in the forefoot 9*a* and heel 9*c* regions of the midsole unit, while the central portion 9*b* is flat. In the embodiment of the invention of FIGS. 1–3, the projections are in the shape of a truncated cone, and are sufficiently spaced so that the projections can act and interact independently with the modulator portion 8*a*, to provide a stable impact absorbing unit. By way of example, in a presently preferred form of the invention, the projections have a 10 mm diameter at the base (i.e., adjacent to the modulator), with a 5 mm diameter at the top of the projections (i.e., the portion of the projection remote from the modulator portion 8*a*). In addition, a center to center spacing distance of the projections can be, e.g., 14 mm (providing a base to base spacing of approximately 4 mm). Of course, the spacings and sizings may vary. In the FIG. 2A arrangement, the projections are arranged in staggered rows, to provide a stable distribution of forces over the regions which include projections. However, alternate patterns of projections are also possible.

Figure 2B:
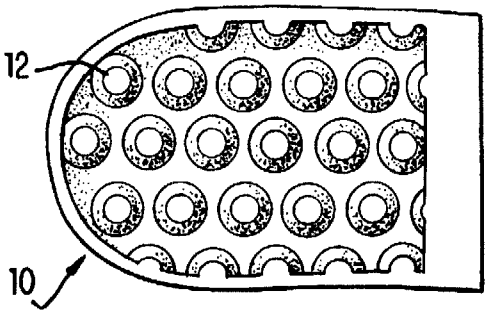
Figure 3:
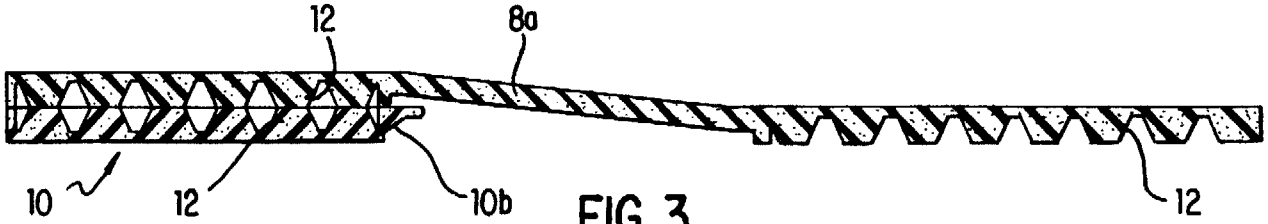
FIG. 3 is a side cross-sectional view of the midsole unit and heel unit of the present invention.
Figure 5A:
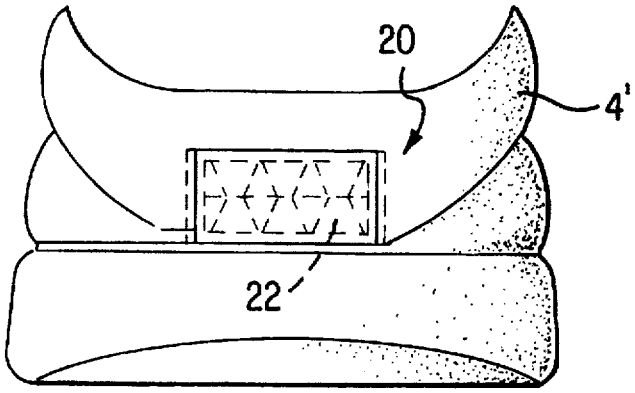
FIGS. 5A–5E depict a modified form of the invention in which a mock window is provided in the shoe exterior.
Figure 5B:
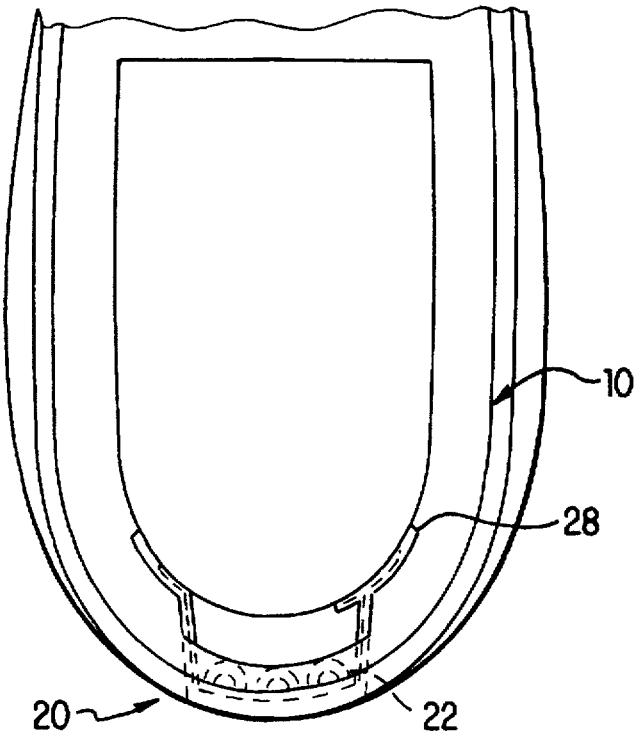
Figure 5C:
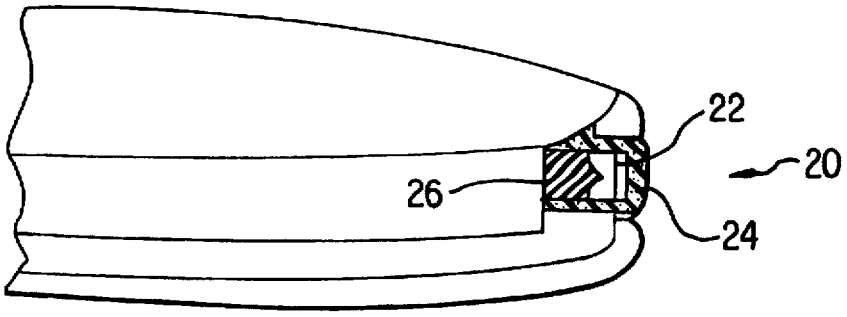
Figure 5D:
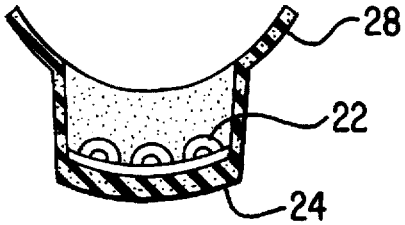
Figure 5E:
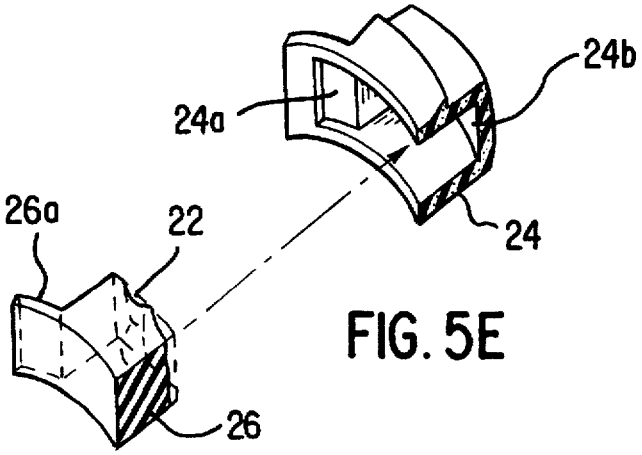

As shown in FIG. 2B, the heel unit 10 includes projections of the same size and spacing as that of the region 9*c* of the midsole unit 8. In the preferred form of the invention, the projections of the heel portion 9*c* and the heel unit 10 face one another as shown in FIG. 3, with the projections of the heel portion of the midsole unit abutting the projections of the heel unit. As a result, an increased spring/cushioning effect is provided in the heel region of the shoe so that the heel region is able to gradually absorb and dissipate substantial energy/impact forces which can be encountered in the heel region.

Utilizing a foam material (e.g., a urethane foam) for the midsole cushioning assembly, and by spacing the projections 12 with respect to one another, the projections are able to act as independent springs spaced about the midsole unit. In addition, by utilizing the double facing projection arrangement in the heel region of the midsole in accordance with the present invention, larger forces are able to be gradually absorbed and dissipated.

As shown in FIG. 3, an inclined portion 10*b* is provided at the front of the heel unit 10. The inclined 10*b* portion is disposed upon an inclined portion 6*d* of the midsole 4 as shown in FIG. 1. This arrangement is advantageous in providing a transition along the midsole between the deep depth portion and the shallow depth portion, while also ensuring that the heel unit is stably disposed in the pocket portion 6*c*. The inclined heel unit portion 10*a* and inclined midsole portion 6*a* avoid an excessively steep transition between the deep depth pocket 6*c* and the shallow pocket portion 6*b*, thereby avoiding stress concentrations.

Figure 4:
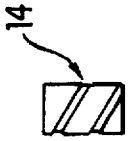
FIG. 4 depicts an alternate configuration of a projection of the cushioning assembly of the present invention.

Referring now to FIG. 4, an alternate form of the projections of the present invention is shown. In the arrangement of FIG. 4, a helical or screw like projection 14 is provided, to further enhance the ability of the projections to absorb impact forces and dissipate energy.

FIGS. 5A–E depict an alternate embodiment of the present invention in which a mock window 20 is provided. Although the mock window 20 is disposed at the rear of the shoe and in the midsole 4' portion of the shoe in FIGS. 5A–E, the mock window 20 can be disposed at other positions (e.g. in the sole and/or along the side of the shoe) if desired. The mock window can display a mock version of the cushioning projections disposed in the midsole of the shoe.

The mock window is advantageous in that it avoids the need for an open aperture extending through the shoe as in prior window arrangements. In addition, by utilizing a mock version of the projections, projections 22 of a reduced size (e.g., 20% smaller than actual size) can be provided, thus reducing the size of the mock window required to depict a series of projections. Further, as shown in FIGS. 5A–5E, the projections can be displayed in cross-section, and such a cross-sectional projection display was not possible with prior window arrangements. Moreover, the mock window arrangement is also advantageous in that the mock projections will not exhibit any deterioration of the actual projections which can occur over an extended period of use, so that a prolonged superior appearance is achieved.

As shown in FIGS. 5A–E, the mock window includes a transparent cover 24, and mock projections 22 held in a filler material 26. As shown particularly in FIG. 5E, the filler material 26 can include a tab portion 26*a* which is received within a recess 24*a* of the cover 24, so that the mock projections 22 are positioned at a desired distance from the front 24*b* of the cover 24. The filler material can be, e.g., polyurethane or other estomeric or resin materials, and can provide support to the midsole region of the shoe to compensate for the intrusion of the mock window from a structural standpoint. Preferably, the cover includes arcuate extensions 28 which partially extend bout the heel cup region of the shoe to provide stable positioning of the mock window 20.

As should be apparent from the foregoing, the present invention provides a structure for an athletic shoe which includes a midsole cushioning assembly which is able to gradually absorb impact forces and dissipate energy while also maintaining sufficient stability. In addition, in accordance with a further aspect of the present invention, a mock window can be provided, which avoids shortcomings associated with providing an actual window which extends into the interior of the shoe.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters: Patent of the United States is:

1. An athletic shoe comprising:

a sole assembly having a pocket;

a midsole cushioning assembly disposed in said pocket, said midsole cushioning assembly including a modulator portion and a plurality of spaced projections extending from said modulator portion such that adjacent projections are spaced from one another wherein said midsole cushioning assembly is formed of a foam material having a Shore C hardness in the range of 60–80, and wherein said modulator portion has a thickness in the range of 2–4 mm; and wherein said projections are spaced to have at least one of: (a) a spacing between adjacent projections of at least 4 mm, and (b) a spacing between centers of adjacent projections of at least 14 mm.

2. An athletic shoe comprising:

a sole assembly having a pocket;

a midsole cushioning assembly disposed in said pocket, said midsole cushioning assembly including a modulator portion and a plurality of spaced projections extending from said modulator portion such that adjacent projections are spaced from one another;

wherein said midsole cushioning assembly comprises:

a midsole unit having a forefoot portion, a central portion and a heel portion, and wherein said plurality of projections extend from said heel portion and from said forefoot portion, and wherein said central portion is substantially flat;

a heel unit disposed below the midsole unit and having a plurality of projections extending therefrom;

wherein the projections of the heel portion extend downwardly toward the heel unit and the projections of the heel unit extend upwardly toward the projections of the heel portion;

said pocket of said sole assembly including:

a first pocket portion which receives the forefoot portion of the midsole unit, said first pocket having a first depth;

a second pocket portion which receives the central portion of the midsole unit, said second pocket portion having a second depth;

a third pocket portion which receives said heel unit and said heel portion of said midsole unit, said third pocket portion having a third depth; and wherein said third depth is greater than said first depth and greater than said second depth, and further wherein said first depth is greater than said second depth.

3. An athletic shoe as recited in claim 2, wherein said midsole cushioning assembly is formed of a foam material having a Shore C hardness in the range of 60–80, and wherein the modulator portion has a thickness in the range of 2–4 mm.

4. An athletic shoe as recited in claim 1, wherein said projections are arranged in rows, and wherein projections of a first row are staggered with respect to projections of a second row adjacent to said first row.

5. An athletic shoe as recited in claim 1, further including:

a mock window assembly disposed in said sole assembly, said mock window assembly including a transparent cover, a mock representation of said projections and a filler material supporting said mock representation of said projections.

6. An athletic shoe as recited in claim 5, wherein said mock representation of said projections comprises a cross-sectional view of said projections.

7. An athletic shoe as recited in claim 6, wherein said mock representation of said projections comprises a reduced size representation of said projections.

8. An athletic shoe as recited in claim 7, wherein said projections have a truncated cone shape.

9. An athletic shoe as recited in claim 1, wherein said projections include a helical recess extending about an outer surface thereof.

10. An athletic shoe as recited in claim 2, wherein said heel unit includes an inclined portion at a front of said heel unit, and wherein said sole assembly includes an inclined portion at a border between said second pocket portion and said third pocket portion, and wherein said inclined portion of said heel unit is disposed on said inclined portion of said sole assembly.

11. An athletic shoe as recited in claim 10, wherein said sole assembly includes a sole and a midsole, and wherein said pocket is disposed in said midsole.

12. An athletic shoe comprising:

a sole;

a midsole disposed on said sole, said midsole including a pocket, said pocket including first, second and third pocket portions respectively having first, second and third depths, wherein said third depth is greater than said first depth and greater than said second depth, and wherein said first depth is greater than said second depth;

a midsole cushioning assembly disposed in said pocket, said midsole cushioning assembly including a contiguous midsole unit and a separate heel unit, said contiguous midsole unit including a forefoot portion disposed in said first pocket portion, a central portion disposed in said second pocket portion, and a midsole unit heel portion disposed in said third pocket portion;

wherein said heel portion of said contiguous midsole unit includes a plurality of projections extending downwardly and said heel unit includes a plurality of projections extending upwardly, and wherein said downwardly extending projections face toward and abut said upwardly extending projections.

13. An athletic shoe as recited in claim 12, wherein said forefoot portion includes a plurality of downwardly extending projections, and wherein adjacent projections of said heel portion and adjacent projections of said forefoot portion are spaced with respect to each other.

14. An athletic shoe as recited in claim 13, wherein said projections have a truncated cone shape.

15. An athletic shoe comprising:

a sole;

a midsole disposed on said sole, said midsole including a pocket, said pocket including first, second and third pocket portions respectively having first, second and third depths;

a midsole cushioning assembly disposed in said pocket, said midsole cushioning assembly including a forefoot portion disposed in said first pocket portion, a central portion disposed in said second pocket portion. and a heel portion disposed in said third pocket portion;

wherein said heel portion includes an inclined portion, and wherein said midsole includes an inclined portion at a border between said second and third pocket portions, with said inclined portion of said midsole inclined at an angle such that said inclined portion is not perpendicular to either a lower surface of said third pocket portion or a lower surface of said third pocket portion and such that said inclined portion provides a ramp extending from said lower surface of said second pocket portion to said lower surface of said third pocket portion, and wherein said inclined portion of said heel portion is disposed on said inclined portion of said midsole and has an inclination which substantially corresponds to an inclination of said inclined portion of said midsole such that said inclined portions mate with each other.

16. An athletic shoe comprising:

a sole;

a midsole disposed on said sole, said midsole including a pocket, said pocket including first, second and third pocket portions respectively having first, second and third depths;

a midsole cushioning assembly disposed in said pocket, said midsole cushioning assembly including a forefoot portion disposed in said first pocket portion, a central portion disposed in said second pocket portion, and a heel portion disposed in said third pocket portion;

the shoe further including a mock window disposed in and extending partially through one of said sole and said midsole, said mock window including a mock representation of said midsole cushioning assembly.

17. An athletic shoe comprising:

a sole;

a midsole disposed on said sole, said midsole including a pocket;

a midsole cushioning assembly disposed in said pocket, said midsole cushioning assembly including a plurality of projections;

a mock window display disposed in one of said sole and said midsole, said mock window display including a transparent cover, a mock representation of said projections, and a filler material supporting said mock representation of said projections.

18. An athletic shoe as recited in claim 17, wherein said mock representation of said projections includes a cross-sectional representation of said projections.

19. An athletic shoe as recited in claim 17, wherein said mock representation of said projections includes a reduced size representation of said projections.

20. An athletic shoe as recited in claim 1, wherein said midsole cushioning assembly includes a midsole unit and a heel unit, and wherein a heel portion of said midsole unit includes a plurality of projections extending downwardly from said modulator portion, and further wherein said heel unit includes a plurality of projections extending upwardly.

* * * * *